US006244023B1

(12) United States Patent
Lataix

(10) Patent No.: US 6,244,023 B1
(45) Date of Patent: Jun. 12, 2001

(54) STERILE INFLATION SYSTEM FOR A SEALED BAG WITH FLEXIBLE WALL

(75) Inventor: Gilbert Lataix, Clermont Ferrand (FR)

(73) Assignee: Laboratoires Merck Sharp & Dohme-Chibret SNC, Paris (FR)

( * ) Notice: Subject to any disclaimer, the term of this patent is extended or adjusted under 35 U.S.C. 154(b) by 0 days.

(21) Appl. No.: 09/423,713

(22) PCT Filed: May 19, 1998

(86) PCT No.: PCT/EP98/03164

§ 371 Date: Nov. 8, 1999

§ 102(e) Date: Nov. 8, 1999

(87) PCT Pub. No.: WO98/52827

PCT Pub. Date: Nov. 26, 1998

(30) Foreign Application Priority Data

May 21, 1997 (FR) ..... 97 06423

(51) Int. Cl.[7] ..... B65B 31/00; B65B 31/08

(52) U.S. Cl. ..... 53/512; 53/432; 53/510; 414/412

(58) Field of Search ..... 53/432, 435, 510, 53/512; 414/411, 412

(56) References Cited

U.S. PATENT DOCUMENTS

| | | | | |
|---|---|---|---|---|
| 2,895,270 | * | 7/1959 | Blaess | 53/432 |
| 5,496,301 | * | 3/1996 | Hlavinka et al. | 604/409 |
| 5,910,138 | * | 6/1999 | Sperko et al. | 604/408 |
| 6,070,397 | * | 6/2000 | Bachhuber | 53/512 |

* cited by examiner

*Primary Examiner*—Peter Vo
*Assistant Examiner*—Hemant M Desai
(74) *Attorney, Agent, or Firm*—James M. Hunter, Jr.; Mark R. Daniel

(57) ABSTRACT

This system comprises a compacted bag, in particular under vacuum, having an appendage into which a spacer device is inserted (2) which forms a pocket (140) separating two facing flexible partition sections from each other (120,121) of which one (121) is adapted to be applied when placed under vacuum against a set of heatable blades with closed outline linked to each other (51, 61) the interior blade (61) being carried by a mobile part (6) of which the end is able to penetrate into the cut pocket (140) with a view to the inflation of the bag with air brought by a channel (600') through a sterilizing filter (8).

3 Claims, 2 Drawing Sheets

STERILE INFLATION SYSTEM FOR A SEALED BAG WITH FLEXIBLE WALL

SUMMARY OF THE INVENTION

This invention concerns a sterile inflation system for a sealed bag, and more specifically for a compacted bag with a flexible wall, in particular placed under vacuum.

The invention is intended particularly but not exclusively for the pharmaceutical industry and/or the medical field, and concerns the economical transfer of loose products or individual objects from a sterile and compacted bag, for example placed under vacuum, to a sterile enclosure.

A transfer technique of this type is the subject of International Application PCT/EP96/05 117, and the bag described in that patent application is particularly suited for use with the sterile inflation system which is the subject of this invention.

This type of bag is made of plastic, heat-sealed from a plastic sheath or sheets, for example from polyethylene with a low level of thickness, of the order of 120 micrometers; the bag presents, when flat, a transfer zone presenting a mouth constituted by a folded zone, able to be expanded to form a pocket adaptable to the transfer chamber of a sterile enclosure.

This invention is particularly suited to a bag of this type which is designed to contain sterile materials or objects, the sterilisation of the bag and its contents being carried out after the materials or objects have been introduced into the bag via an appropriate filling appendage and the bag has been re-sealed by heat-sealing or sealed.

More particularly, the invention is intended for a configuration in which the bag is compacted, that is to say, a bag in which the internal surfaces of the bag wall are more or less closely flattened one against the other, through the creation of a certain vacuum within the bag, this arrangement having the advantage of immobilising materials or objects therein and preventing or limiting their movement during transit; another advantage of compacting, naturally, is to reduce the space occupied by the bag.

When one wishes to transfer the contents of the bag into a sterile enclosure, in particular by means of a system in accordance with the above-mentioned patent application PCT/EP96/05 117, the bag must be inflated first. This enables the bag wall to expand to size, freeing the products it contains and the bag mouth to be adapted to the transfer chamber.

To do this, there is however one problem, associated with the fact that the bag wall is compacted and that its internal facing surfaces are in contact with each other, or at least very close to one another.

It is difficult, even impossible, to cut one wall only without piercing the opposite wall.

The purpose of the present invention is to solve this problem.

This objective is achieved due to the fact that the sterile inflation system for a sterile and compacted sealed bag with flexible wall, in particular placed under vacuum, which is the subject of the invention, comprises:

a) a bag which presents at least one appendage into which a spacer device has been inserted which forms a pocket between the interior surfaces of the bag, separating from each other two facing, flexible, partition sections of its wall, this pocket connecting with the interior space of the bag;

b) an inflation chamber comprising a fixed, exterior part and a mobile, interior part, which constitutes a cutting/inflation device;

in which:

c) the fixed and mobile parts are each fitted with a heatable blade with closed outline, one exterior, integral to the fixed part and the other interior, integral to the mobile part, these two blades being linked and joined at their apex in an airtight manner when the inflation chamber is in the closed state.

d) the inflation chamber and the outline of the spacer device are shaped in such a way that it is possible to adapt the pocket containing the spacer device to the exterior part so that one of the flexible partition sections is positioned in relation to the set of blades;

e) the inflation chamber is equipped with vacuum outlets capable of applying the flexible partition section of the bag by means of suction against the heated blades and to initiate the cutting by fusion of the zones which come into contact with the blades;

f) the said mobile part is fitted with an inflation channel, with a sterilising filter, through which air may pass into the space formed by the interior of the pocket when the inflation chamber is in the open state.

In a particularly advantageous embodiment of this system, the said spacer device is markedly cup-shaped, comprising a base and a raised rim or skirt, the latter presenting at least one opening which connects the space formed by the interior of the rim to the exterior of the rim.

The invention also comprises a bag with flexible wall intended for use in a system as described above.

This bag is remarkable in that it comprises at least one appendage containing an spacer device which forms a pocket between the interior surfaces of the bag, separating two facing flexible partition sections of its wall from each other, this pocket connecting with the interior space of the bag.

Other characteristics and advantages of the invention will appear from the description and the drawings in annex which show, by way of non-limitative example, a preferred method of embodiment of the invention.

DETAILED DESCRIPTION

Figure 4:
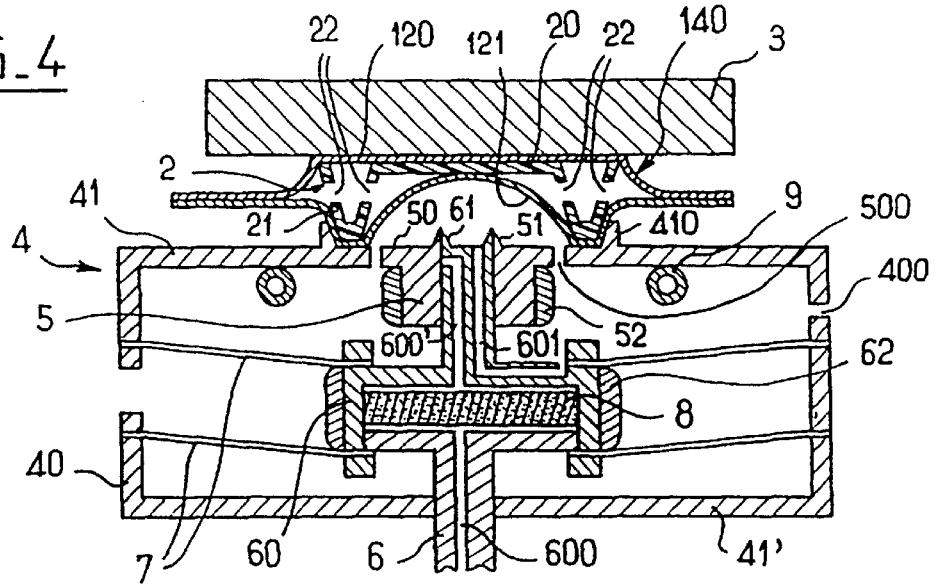
FIG. 4 is a diagrammatic view, in cross-section, of the system, the inflation zone of the bag being mounted on the cutting/inflation chamber, before the start of the operation.
Figure 5:
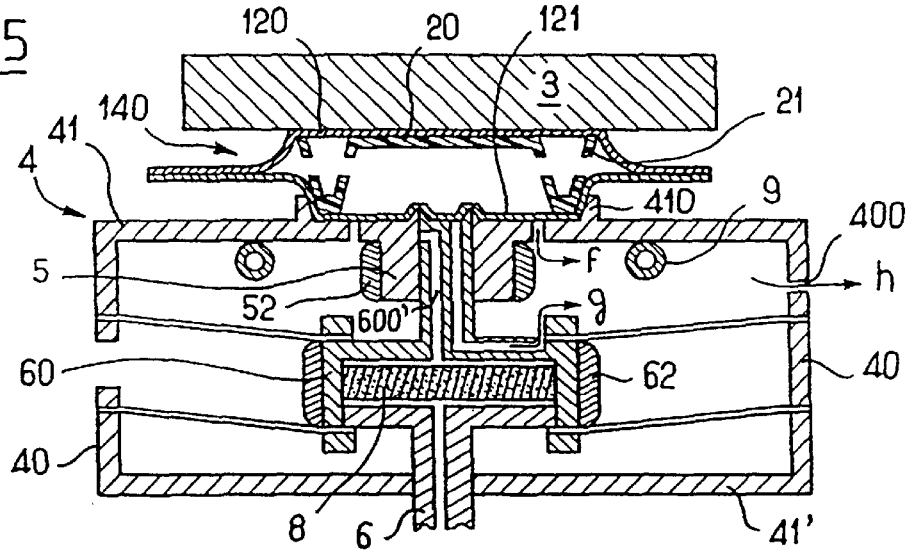
FIGS. 5 and 6 are views similar to FIG. 4 which illustrate the operations of cutting and inflation respectively.
Figure 6:
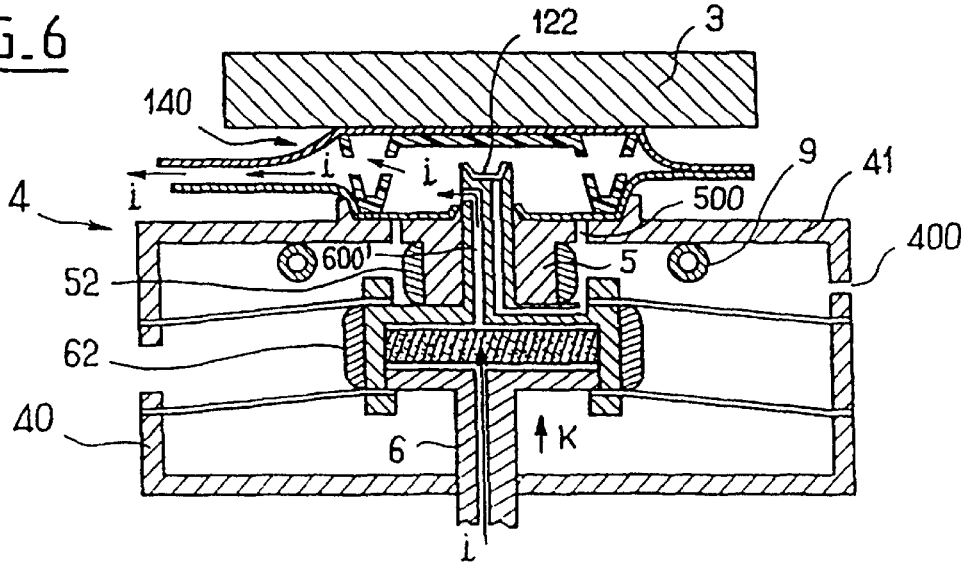

In FIGS. 4 and 5, the inflation chamber is seen in the state known as closed while in FIG. 6 it is seen in the state known as open.

Figure 1:
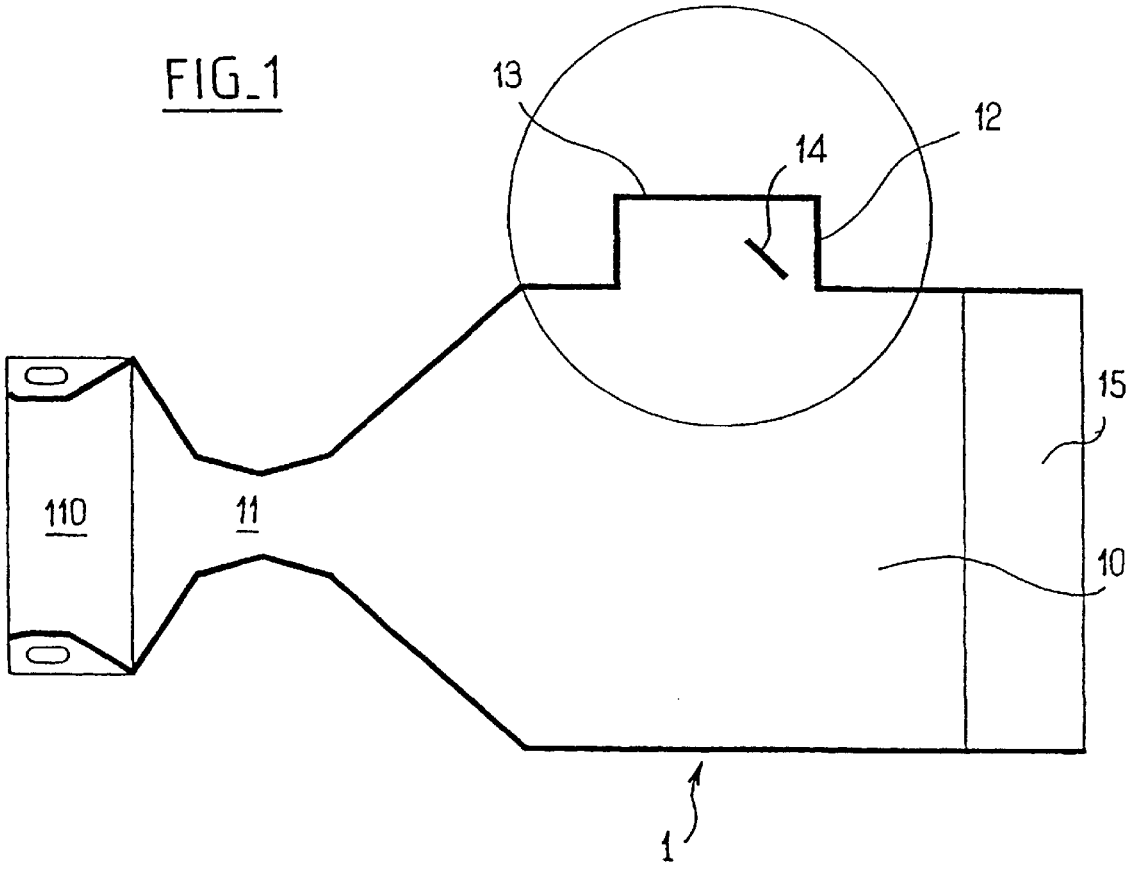
FIG. 1 is a diagrammatic general view of a flexible bag made of plastic as could be used in the system according to the invention.

The bag shown in FIG. 1 is a bag comprising a flexible wall, made from a sheet of plastic, transparent or non-transparent, which can be heat cut by fusion; for example polyethylene with a low level of thickness, of the order of 120 micrometers.

It concerns an airtight envelope in which the edges are hermetically sealed by a line of heat-sealing which integrates the front and rear surfaces of the envelope.

The bag 1 comprises a main body 10, a neck 11, through which the materials or objects contained within the main body can pass to be transferred into a sterile enclosure and a mouth 110 adaptable to a transfer chamber; at the other end, the bag comprises a bottom section 15 which is preferably formed by a fold in the plastic sheet.

A bag of this type is described in the above-mentioned PCT patent application, which can be referred to if necessary.

This bag, which is shown empty and flat in FIG. 1, comprises a filling appendage 12, which is sealed by a line of welding 13.

The appendage 12 has an oblique line of welding 14 running through it which partially seals one of its corners, towards the exterior of the bag.

Figure 2:
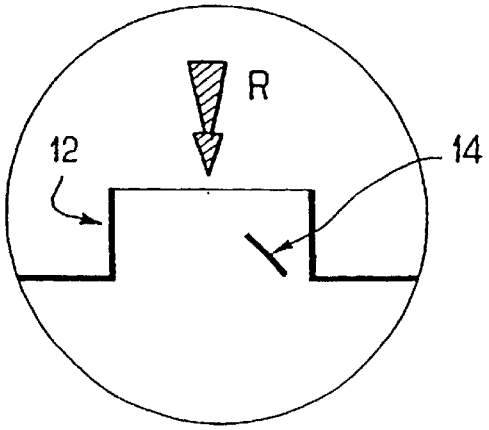
FIG. 2 is a detail of the circled section of FIG. 1, which shows the filling appendage of the bag during the filling operation.

In a preferred filling procedure for the bag, first the line of welding 13 is cut which opens the appendage 12. Then the products are introduced into the interior of the bag, via this appendage, as indicated by arrow R in FIG. 2.

Figure 3:
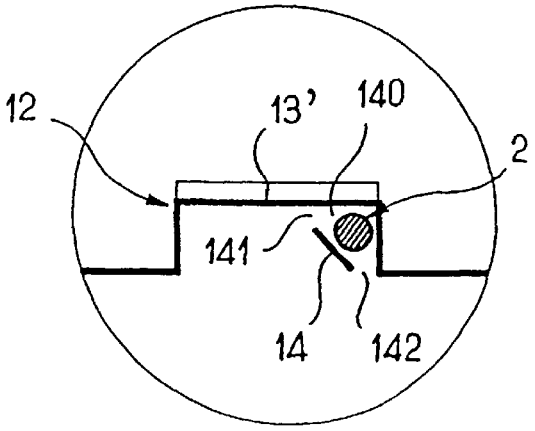
FIG. 3 is a similar view to FIG. 2, after insertion of the spacer device into the filling appendage and hermetic sealing of the appendage.

Next an insert 2 is introduced, more specifically, into the corner zone delimited by the weld 14 (see FIG. 3).

The insert 2 is a spacer device which will be described below.

The reference 140 has been used to indicate the corner zone where element 2 is located.

Next, the bag is compacted by removing the air in it, by suction for example, in order to achieve a certain vacuum, after which the opening of the appendage 12 is sealed by a weld 13'.

It will be noted on observing FIG. 3 that the weld line 14, set obliquely, is of limited length and that at its extremities there remain unwelded zones 141–142 which connect zone 140 with the interior of the bag.

As will be seen below, the spacer device 2 gives the zone 140 the shape of a pocket which will enable, when required, the cutting of one only of the two facing partition sections of the appendage 12, with a view to the inflation of the bag.

The spacer device 2 represented in FIGS. 4 to 6 has the shape of a cup with a circular outline. It is made of plastic, preferably the same type as the bag (polyethylene) so that the bag and the spacer may be processed together for recycling after use.

The spacer device 2 comprises a discoid base 20 and an annular rim or skirt 21, with a double wall with a V-shaped cross-section which is traversed by radial vents 22.

The inflation system is composed of a supporting element 3 or anvil in the form of a plate and an inflation chamber 4 which is equipped with a mobile part in the form of a plunger 6.

The axis of the plunger 6 is perpendicular to the plate 3.

In the example shown in FIGS. 4 to 6, this axis is vertical and the chamber 4 is located below the horizontal anvil 3.

The chamber 4 is in the form of an airtight box which has one cylindrical wall 40 and two horizontal, flat, front walls 41, 41'.

The upper wall 41 is fitted with an annular protuberance 410. This has an internal bevelled edge, in which the slope corresponds to the slope of the external wall of the rim 21 in such a way that it is adapted to centre the spacer device 2 when the pocket 140 which contains it is held between the chamber 4 and the anvil 3 (see FIG. 4).

Appropriate drive mechanisms, not shown, are provided for moving the anvil 3 and the chamber 4 towards each other in order to immobilise correctly the pocket 140 which has to be opened to inflate the bag.

Appropriate elastic return devices 7 generally push the plunger 6 downwards (see FIGS. 4 and 5).

The central section of the upper wall 40 has a fixed metal part which constitutes a cylindrical cutting head 5 which penetrates downwards into the interior of the chamber 4. This head 5 is surrounded by an electric heating device 52. Its upper side 50—which is flush with the plane of the upper side of the wall 41—is fitted with an external metal cutting blade 51 with a closed outline, circular for example.

The upper end of the plunger 6 axially passes through a central hole formed in the cutting head 5. It is fitted with an exterior metal cutting blade 61, which has the same outline as blade 51.

These two blades have a right-angled triangular cross-section and are joined at their apex in an airtight manner when the inflation chamber is in the closed state illustrated in FIGS. 4 and 5. The plunger 6 consists of a rod which has an enlargement 60 located within the chamber 4. The enlargement 60 is surrounded by a ring-shaped electric heating device 62.

The heating devices 52 and 62 are high frequency induction coils designed to heat parts 5 and 6, in particular the metal blades 51 and 61.

The interior of the chamber 4 is connected to a vacuum source, for example a vacuum pump, by means of a channel 400 and a suitable pipe, not shown.

The plunger 6 has 2 longitudinal channels, 600-600' on the one hand and 601 on the other.

Channel 600, 600' is connected, at the lower end of the plunger, via a suitable pipe not shown, to a source of compressed air.

It passes through a filter 8 mounted in the enlargement 60. At its upper end this channel opens laterally at a level located below the blade 61 within the cutting head 5.

References 600 and 600' have been used to indicate the sections of the channel which are found respectively below—that is upstream and above—that is downstream—of the filter 8.

The filter 8 is a pad made of heat-resistant, synthetic, fibrous fabric, the porosity of which is of the order of 22 micrometers which ensures that the air which comes out of the filter through the channel 600' is completely sterile.

In addition, this filter is also heated by the electrical device 62 in such a way that it is completely sterilised at the same time as the plunger 6, at a high temperature, preferably of the order of 200° C.

This concerns, therefore, a sterilising filter.

The channel 601 opens at its lower end above the enlargement 60, within the chamber 4; it opens at its upper end at the frontal side of the plunger, inside the blade 61.

The interior of the chamber 4 is also connected through the wall 40 with the exterior by the annular slot 500 which borders the cutting head 5 within the centring protuberance 410.

In reality, the annular slot 500 is not continuous. Part 5 is linked to the wall 41 by suitable crosspieces made from an insulating material.

In the interior of the chamber 4, just below the wall 41 of the box, a cooling device is fitted, for example in the form of an annular pipe 9 in which a cooling liquid circulates.

This design ensures that the walls of the chamber, notably the upper wall 41, are maintained at a moderate temperature. This prevents, in particular, any risk of burns to the users and of fusion of the plastic bag if it accidentally comes into contact with the box. Thus only parts 5 and 6 are heated to a high temperature during the operation.

An appropriate means of driving, for example an hydraulic or pneumatic cylinder—not shown—is provided to move the plunger 6 upwards during the cutting/inflation operation as will now be explained.

As the interior of the bag is under negative pressure, in particular under vacuum, the bag wall is compacted and the pocket 140 in cross-section has approximately the shape shown in FIG. 4. By means of the presence of the spacer device 2 the two facing partition sections 120, 121 are pushed away from one another and kept apart.

The partition 120 is applied against the flat base section 20, while the partition 121 forms a dome within the rim 21, its central section resting against the facing side of the base section 20.

To commence the inflation operation, the rim 21 of the cup-shaped spacer device 2 is adapted to the fixed exterior part of the inflation chamber 4 and held in place by means of the anvil 3. The annular protuberance 410 ensures correct centring of the pocket 140 and of the insert 2 which it holds between the anvil and the chamber. The electrical supply to the heating devices 52,62, is switched on, which has the effect of heating the blades 51,61 and the filter 8 to the required temperature, for example to a temperature of the order of 200° C., for several minutes, enough to sterilise the blades and the filter; then the temperature is allowed to fall, for example to 120° C.

To cut the plastic of the section 121 by the combination of suction against the blades and fusion, a vacuum is applied by connecting the chamber 4 to a vacuum pump by opening the appropriate valve, not shown.

For information, the pressure (negative) of this placing under vacuum is of the order of $2.10^4$ Pascal.

In this way, the flexible zone 121 of the pocket 140 moves downwards towards the upper sides of parts 5, 6 and is applied against the set of heated blades 51, 61.

The arrows f, g and h in FIG. 5 indicate the escape of air during this suction.

The vacuum, combined with the fusion of the plastic, has the effect of cutting the flexible zone on each side of the blades, with the creation of an airtight contact between each cut part of the plastic film and the surface of the blade, a ridge seal forming at this point. These airtight contacts isolate the non-sterile zones on the exterior of the film.

Any micro-organisms which might be found on the exterior surface of the film are therefore confined under the film by these ridges and they cannot penetrate the interior of the bag during the operation.

Naturally, the vacuum continues to be applied, with the result that the cut plastic remains closely adhered to the blades and to elements 5 and 6.

The power supply is then switched off and the set of blades is allowed to cool down, after which the inflation chamber can be opened. To do this, the plunger 6 is moved upwards and enters the space formed by the interior of the spacer rim. This movement is indicated by the arrow K in FIG. 6.

The stroke of the plunger 6 is sufficient to expose the mouth of the channel 600', oriented radially, inside the pocket, so that the air can pass through the sterilised filter in order to inflate the bag through the openings 22 as indicated by the arrows i in FIG. 6.

The central discoid part 122 of the cut zone remains adhered through suction to the further side of the plunger inside the sterile enclosure. This is not a problem as it is the sterile side—the side which was inside the bag before cutting—of the discoid part which is exposed to the sterile environment. In contrast, the air liable to be contaminated which is at the other side of the other discoid part is confined, in an airtight fashion, through the presence of the annular ridge of plastic fused to the blade and also due to the application of the vacuum.

There is no risk during the operation that the partition section 120 will be pierced by the blades because it is protected by the base 20 of the spacer device.

Once the inflation operation is complete, the appendage containing the spacer device is hermetically sealed by a conventional heat-sealing method which enables at the same time the detachment of the appendage and the spacer device from the rest of the sterile bag, which is now inflated.

The source of the vacuum is then disconnected from the chamber by means of the appropriate valves and the cut appendage is removed as are the cut parts adhering to the cutting blades.

The inflation chamber is now ready for a new, similar operation on a new bag.

In the preferred embodiment which has just been described, the spacer device is circular, comprising a flat base section and a raised rim which, in cross-section has a marked trapezoid shape in which the wide base is parallel to the bottom section 20 and in which the sides converge away from the base. The rim or skirt, comprises at least one opening 22, for example, from 3 to 6 openings, which connect the space formed by the interior of the rim to the exterior of the rim.

The general shape of the spacer device may be other than circular, in particular polygonal, for example, square or in the form of a pentagon or hexagon, given that in that case the protuberance 410 would have a corresponding shape. A circular shape is chosen advantageously to facilitate the fitting of the insert onto the inflation chamber.

In addition, the spacer device is not necessarily cup-shaped. Other configurations may be used, the only conditions required being that the spacer device separates correctly and cleanly the two facing partition sections of the pocket from each other, that it enables the centring of the pocket on the inflation chamber and that it permits insufflation of air into the pocket and the inflation of the bag. To do this, a simple pad of spongy material permeable to air could be used.

Instead of heating the cutting blades by induction, other conventional heating methods could be used; for instance, heating elements with low thermal inertia acting by Joule effect.

The system which is the subject of the invention is not restricted to the transfer of sterile products; it can also be used for the transfer of products or components for which isolation and confinement in respect of the exterior air must be guaranteed; this applies particularly to toxic, dangerous, pathogenic, radioactive or air-sensitive products.

The system is particularly suitable for use in the pharmaceutical or cosmetic industries, for the transfer of radio-sterilised plastic flasks or packaging components to a sterile enclosure where they will be filled, stoppered, sealed, welded, etc. in a sterile fashion.

What is claimed is:

1. A sterile inflation system for a bag with flexible wall which is sterile and compacted, and under vacuum, comprising:

a) a bag (1) which has at least one appendage (12) into which a spacer device (2) is inserted which forms a pocket (140) between the internal surfaces of the bag, separating two facing flexible partition sections (120, 121) of its wall from each other, this pocket (140) being connected to the interior space of the bag (1);

b) an inflation chamber (4) comprising a fixed exterior part (5) and a mobile interior part (6), which comprises a cutting/inflation device; wherein:

c) the fixed and mobile parts (5,6) are each fitted with a heatable blade with closed outline, one (51) exterior, integral to the fixed part (5), and the other (61) interior, integral to the mobile part (6), the two blades (51, 61) being linked and joined at their apex in an airtight manner when the inflation chamber (4) is in the closed state;

d) the inflation chamber (4) and the outline of the spacer device (2) are shaped to adapt the pocket containing the spacer device to the exterior part (5) so that one of the flexible partition sections (121) is positioned in relation to the set of blades (51, 61);

e) the inflation chamber is fitted with vacuum channels (500, 601, 400) capable of applying a vacuum to the flexible partition section (121) of the bag through suction against the heated blades (51, 61) thereby initiating cutting by fusion of the zones coming into contact with the blades; and f) the said mobile part is equipped with an inflation channel (600-600') fitted with a sterilizing filter (8) through which the air can pass to enter the space formed by the interior of the pocket (140) when the inflation chamber is in the open state.

2. A system of sterile inflation according to claim 1 in which the said spacer device (2) is markedly cup-shaped, comprising a base (200) and a raised rim (21) the latter having at least one opening (22) which connects the interior space of the rim to the exterior space of the rim.

3. A system of sterile inflation according to any one of claim 1 or 2 in which the bag further comprising at least one appendage (12) containing a spacer device (2) which forms a pocket (140) between the internal surfaces of the bag separating two facing flexible partition section (120, 121) of its wall from each other, said pocket (140) being connected to the interior space of the bag (1).

* * * * *